US005211549A

United States Patent [19]

Kraemer

[11] Patent Number: 5,211,549

[45] Date of Patent: May 18, 1993

[54] FUEL INJECTION PUMP

[75] Inventor: Manfred Kraemer, Schwieberdingen, Fed. Rep. of Germany

[73] Assignee: Robert Bosch GmbH, Stuttgart, Fed. Rep. of Germany

[21] Appl. No.: 833,190

[22] Filed: Feb. 10, 1992

[30] Foreign Application Priority Data

Sep. 30, 1991 [DE] Fed. Rep. of Germany ..... 4132502

[51] Int. Cl.[5] ..... F04B 7/04

[52] U.S. Cl. ..... 417/499; 417/494; 123/500

[58] Field of Search ..... 417/490, 499, 494; 123/500, 503, 449

[56] References Cited

U.S. PATENT DOCUMENTS 4,737,085 4/1988 Güntert et al. ..... 417/494
4,817,716 3/1989 Güntert et al. ..... 123/500
4,830,587 5/1989 Güntert et al. ..... 417/499
4,850,822 7/1989 Güntert et al. ..... 417/499
5,097,812 3/1992 Augustin ..... 417/494

*Primary Examiner*—Richard A. Bertsch
*Assistant Examiner*—Charles G. Freay
*Attorney, Agent, or Firm*—Edwin E. Greigg; Ronald E. Greigg

[57] ABSTRACT

A fuel injection pump for internal combustion engines, having a reciprocating pump piston and an annular slide displaceable on the pump piston and having a control bore which cooperates with a control recess on a pump piston that communicates with the pump work chamber via a conduit. Because of a crooked position of the control bore with respect to the piston axis, an ellipse-like opening cross section is created, which in cooperation with the oblique control edge opens a fast, large opening cross section, by way of which in cooperation with an equal pressure valve disposed in the injection line, the fuel can flow out quickly, and a reliable, fast closure of the injection valve is assured. A pressure holding valve is also provided which opens toward the work chamber.

11 Claims, 1 Drawing Sheet

FIG. 1
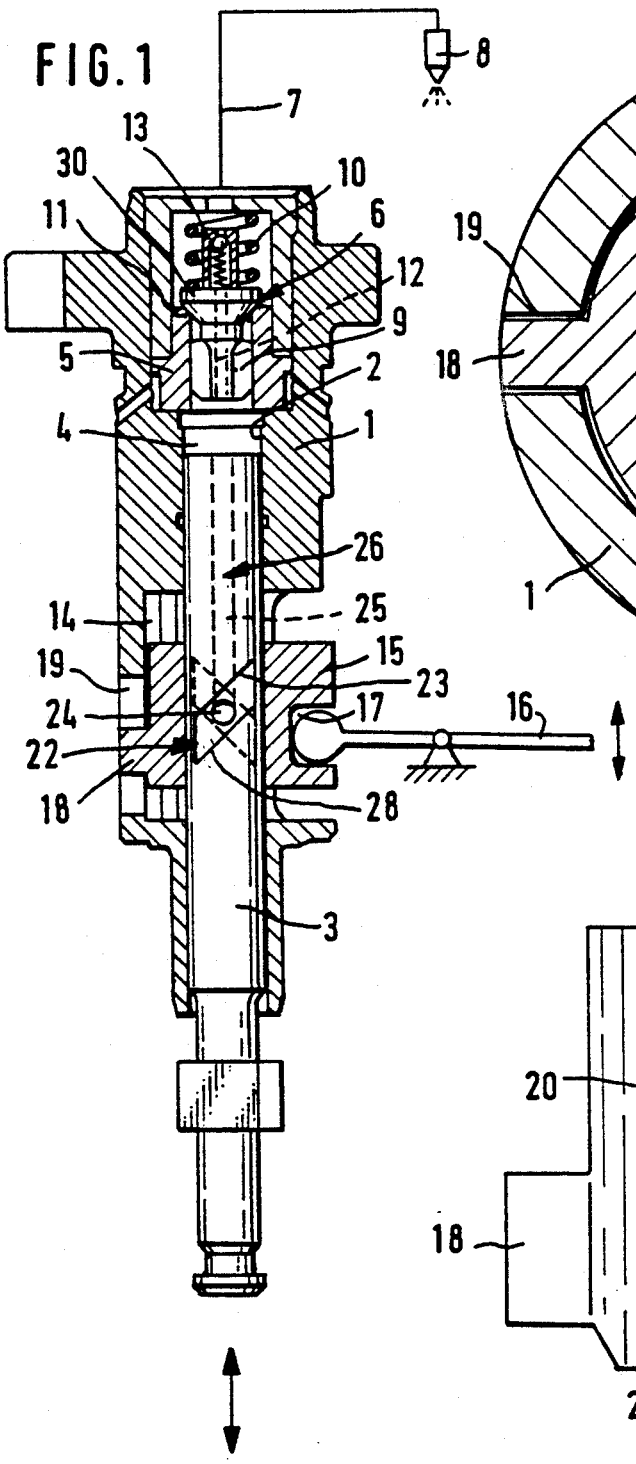
FIG. 2
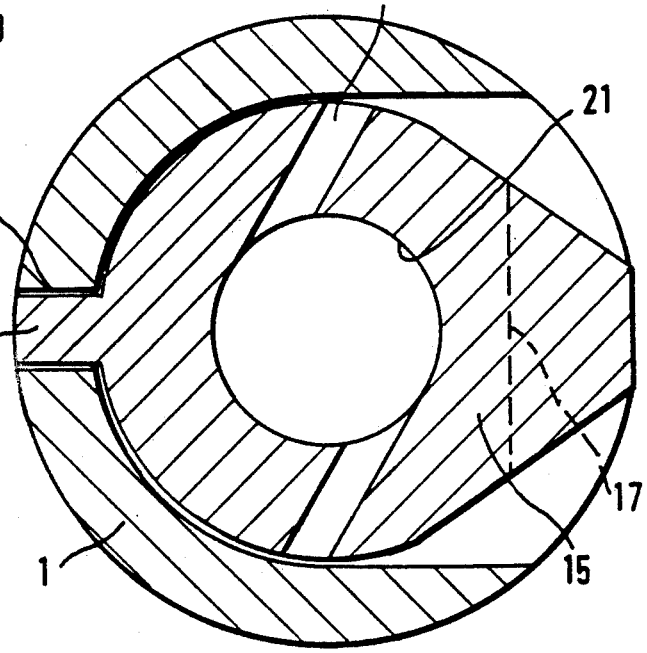
FIG. 3
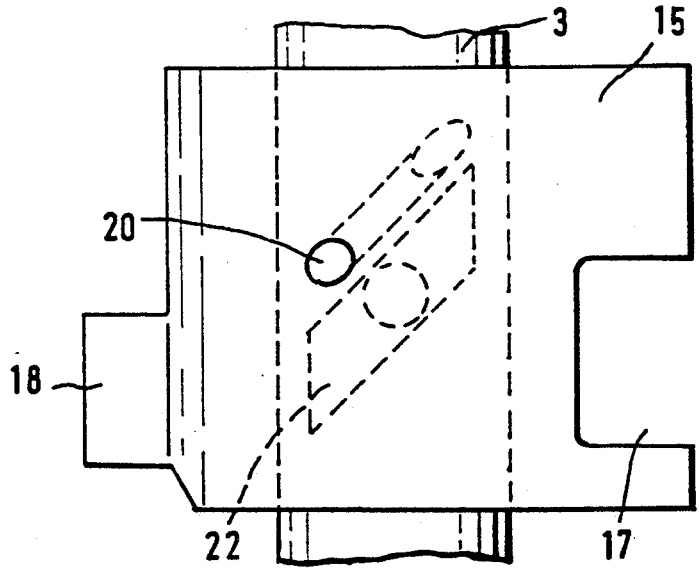
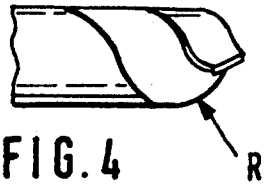
FIG. 4

FUEL INJECTION PUMP

BACKGROUND OF THE INVENTION

The invention is based on a fuel injection pump as defined hereinafter. A fuel injection pump of this type is known from German Patent 37 66 313. In it, the onset and end of supply are controlled by an annular slide that is axially displaceable on the pump piston; the end edge of the annular slide controls the supply onset when the pump piston control recess enters the inner bore of the annular slide, and a radial control bore disposed in the peripheral wall of the annular slide, along with the control edge toward the pump work chamber of the oblique groove, controls the end of supply. Especially in fuel injection pumps that operate with a high injection pressure, problems in the diversion process occur. The high fuel pressures of up to 1300 bar that arise during the supply stroke have to be dissipated as rapidly as possible, in order by means of a steep pressure drop in the injection line to attain the fastest possible injection valve needle closure, and thus to reduce particle emissions.

OBJECT AND SUMMARY OF THE INVENTION

The fuel injection pump according to the invention has an advantage over the prior art that because the control bore is disposed obliquely in three-dimensional terms, an opening cross section that is greater than the radius of the control bore itself is produced. This enables a rapid increase in fuel flow at the beginning of the coincidence of the control edge and the control bore inlet opening, and hence a rapid pressure relief of the pump work chamber, without a control bore of increased diameter that weakens the strength of the annular slide. It is advantageous to dispose the control bores in a clockwise direction out of a center position by from 10° to 30°. In this angular position, a nearly ellipse-like intersection line between the inner bore of the annular slide and the obliquely disposed diversion bore is obtained, this intersection line cooperating with the diversion groove of the piston; the obliquely disposed diversion bore has an effective radius that is substantially greater than the original radius of the control bores in the annular slide. In addition, when the control bore is tilted in a direction remote from the pump work chamber, out of the radial plane of the pump piston, the space available for the outflow of the fuel inside the control bore is already very high when the opening stroke is still short, compared with other axial positions of the control bore; this in turn has advantages in terms of pressure relief of the pump work chamber, because the outflowing fuel can spread out unhindered, so that the flow resistance decreases during the diversion process. If the control bores are rotated out of the central position by a large angle of 20° to 30° in the radial plane of the pump piston, then in the region where the intersection line comes to a sharp point there will be no control edges having a virtually right angle; instead, a flat pocket in the inner wall of the annular slide is produced, in which dirt particles settle. That can be avoided, if when the control bores are made in the annular slide, a forming tool (such as a drill or milling cutter) is used that has rounded corners between the tip and the shank, and with which drilling is not done all the way into the inner bore of the annular slide but rather only far enough that an ellipse-like inlet opening is created. Another advantage is attained if an equal pressure valve is used; this makes it possible to assure a constant outlet pressure at a low pressure level in the injection line, over the entire operating range of the fuel injection pump. This enables reliable injection of the injection quantity required over the defined injection time. Furthermore, the equal pressure valve, by opening a large outflow cross section during the diversion process at the end of the supply stroke, enables fast, reliable closure of the injection valve. Other advantages and advantageous features can be found in the ensuing description and in the drawings.

The invention will be better understood and further objects and advantages thereof will become more apparent from the ensuing detailed description of a preferred embodiment taken in conjunction with the drawings.

BRIEF DESCRIPTION OF THE DRAWINGS

FIG. 1 shows part of a fuel injection pump in longitudinal section, with an annular slide that is displaceable on a pump piston;

FIG. 2 is a section through the pump piston, the annular slide and its control bores on a larger scale, in the radial plane;

FIG. 3 is a schematic view of the ellipse-like intersection line between the inner bore of the annular slide and the spatially obliquely disposed control bore; and FIG. 4 is a front view of a machining tool for making the control bore in the annular slide.

DESCRIPTION OF THE PREFERRED EMBODIMENT

The description of the part of a known fuel injection pump shown in FIG. 1 will be limited to the structure serving to explain the subject of the invention. In a pump housing, not shown per se, there is a cylinder liner 1 with a pump cylinder 2, in which a pump piston 3 encloses a pump work chamber 4 and is moved axially by a camshaft, also not shown. Adjoining the pump work chamber 4 is an equal pressure valve 6, disposed in a fuel injection line 7 to an injection valve 8. This equal pressure valve 6 comprises a valve member 30, which opens in the opening direction toward the injection valve 8, a pressure valve body 5, and a pressure holding valve, embodied as a ball valve, which opens toward the pump work chamber 4. The valve member 30, is guided axially in the pressure valve body 5 by a guide element 9 and is pressed by a pressure valve spring 10 supported on the housing onto a valve seat 11 of the pressure valve body 5, counter to the direction of flow toward the injection valve 8. In its interior, the valve member 30 has an axial through bore 12, which is closed by the pressure holding valve 13 on the side of the valve member 30 remote from the pump work chamber 4. The pressure holding valve 13 enables a return flow of fuel from the injection line 7 into the pump work chamber 4. Disposed in the cylinder liner 1 enclosing the pump work chamber 4 is a recess 14, which receives an annular slide 15 that is axially displaceable on the pump piston 3, the annular slide surrounds the pump piston in bowl-like fashion and opens a transverse opening through which a two-armed adjusting lever 16, supported integrally with the housing, can engage a recess 17 of the annular slide 15 and displace it axially on the pump piston 3. The annular slide 15, which is secured against twisting via a rib 18 in a longitudinal groove 19 of the cylinder liner 1 that extends axially with respect to the pump piston, has two control bores 20 opposing one another in point symmetry with respect to the pump piston axis; the center axes of the control bores do not intersect the piston axis and are rotated clockwise out of the center position by approximately 10° to 30° in the radial plane of the pump piston, and additionally are tilted by approximately 10° to 30° out of the radial plane of the pump piston 3 in the direction remote from the pump work chamber 4. With respect to a center plane passing through the longitudinal groove 19 or the rib 18 and the pump piston axis, they are located opposite one another. By means of this described position of the control bores 20 in the annular slide 15, which is shown in FIGS. 2 and 3, large ellipse-like control bore inlet cross sections are created according to the invention at the area where the control bore 20 passes through the inner wall 21 of the bore of the annular slide 15 receiving the pump piston. Since when the control bores 20 are turned in the radial plane by relatively large angles, pockets with a non-radially oriented wall are formed on the annular slide inner wall 21 in the region of the intersecting line coming to a sharp point between the inner wall 21 of the annular slide 15 and the obliquely disposed control bore 20, on one side in the secondary vertex of the ellipse of the inlet opening, the danger exists that dirt particles can settle at this point. This can be avoided by means of a forming tool, shown in FIG. 4, for producing the control bore 20 in the annular slide 15. In that case, the control bores are not drilled all the way through to the inner bore 21 of the annular slide 15 but rather are drilled only far enough to create an approximately elliptical inlet opening, but with a radially oriented end portion of the control bore 20, matching the rounded configuration of the drill tip. The machining tool (such as a drill or milling cutter) accordingly has not only a drilling tip but also rounded edges at the transition to the bore shank. In a drill 5 mm in diameter, for instance, this radius R shown in FIG. 4 would be 1 to 2 mm. For determining the injection quantity, and in particular for controlling the end of the supply during the supply stroke, the control bores 20 cooperate with two oblique grooves, machined into the jacket face of the pump piston 3 with point symmetry to one another in the form of control recesses 22, which grooves rise at a predetermined angle to the longitudinal axis of the pump piston 3 and have two parallel oblique control edges, of which one control edge 23 is located nearer the pump work chamber 4 and the other control edge 28 is located farther away from the pump work chamber 4. Discharging into the middle of the control recesses 22 is a transverse bore 24, which communicates with a blind bore 25 that begins at the pump work chamber 4 and extends axially in the pump piston 3; the transverse bore 24 and the blind bore 25 form a conduit 26 between the control recesses 22 and the pump work chamber 4. The control bores 20 are aligned, by the above provision, such that they are substantially elliptically parallel to the control edge 23 of the control recesses 22. The control bores 20 may be disposed such that they either rise toward or fall away from the pump work chamber 4.

The fuel injection pump according to the invention functions as follows.

Once the pump piston 3 assumes its bottom dead center position, the control recesses 23 have emerged from the inner bore 21 of the annular slide 15 and communicate with the low-pressure chamber, so that in the intake stroke of the pump piston 3 the fuel can flow into the work chamber 4 via the transverse bore 24 and the blind bore 25. During the supply stroke of the pump piston 3, the control recess 22 enters the annular slide 15 to an extent that is adjusted by the adjusting lever 16 in accordance with the axial position of the annular slide 15. As soon as the control edge 28 remote from the pump work chamber has moved past the lower end edge of the annular slide 15, pressure required for the injection can build up in the pump work chamber 4; the equal pressure valve 6 is opened at an opening pressure of from about 5 to about 10 bar counter to the force of the pressure valve spring 10, and the fuel flows via the injection line to the injection valve 8. Supply continues until such time as the control bores 20 in the annular slide 15 are opened, by the control edges 23 of the control recesses 22 located closest to the pump work chamber 4, so that the pressure drop interrupts the injection. The equal pressure valve 6 disposed in the injection line 7 reinforces a rapid outflow of the fuel, which is at high pressure, because the pressure valve spring 10, which is prestressed with less than the usual initial tension, provides only little reinforcement for seating of the valve member 30 on the valve seat 11, so that a large proportion of the fuel that is at high pressure in the injection line 7 can flow very quickly away via the large opening cross section between the valve seat 11 and the valve member 30 before the pressure valve 11, 30 closes, and some of the remaining fuel flows in throttled fashion via the pressure holding valve 13, embodied as a ball valve, until the defined static pressure in the injection line 7 is attained and the pressure holding valve 13 likewise closes.

This embodiment of the equal pressure valve 6 accordingly for the first time enables a truly effective fast large opening cross section at the control bore 20 of the annular slide 15, because the increase quantity of fuel flowing out of the pump work chamber 4 can now also follow from the injection line 7, so that a fast closure of the injection valve 8 is thus attained via the faster pressure relief in the injection line 7.

As the stroke of the pump piston 3 continues up to the dead center, the fuel flows out of the pump work chamber 4 through the blind bore 25, the transverse bore 24, the control recesses 22 and the control bores 20 back into the low-pressure chamber of the fuel injection pump. By means of the opening cross section according to the invention of the control bores 20 in cooperation with the control edges 23, 28 of the control recesses 22, a large passageway area for the outflowing fuel is already created when the coinciding stroke between the control edge 23 and the outlet cross section of the control bore 20 is still slight, so that a rapid pressure decrease in the input work chamber 4 is assured, which continues via the equal pressure valve 6 of the invention on into the injection line 7, thus resulting in a reliable and fast closure of the injection valve 8.

The foregoing relates to a preferred exemplary embodiment of the invention, it being understood that other variants and embodiments thereof are possible within the spirit and scope of the invention, the latter being defined by the appended claims.

What is claimed and desired to be secured by letters patent of the United States is:

1. A fuel injection pump for internal combustion engines having at least one reciprocating pump piston (3) defining a pump work chamber (4) in a pump cylinder (2), said piston has at least one control recess (22) on a jacket face which communicates through an axial conduit (26) with the pump work chamber (4), an oblique control edge (23), (28) that extends at a predetermined angle with respect to an axis of the pump piston (3), an annular slide (15) that is adjustable on the pump piston (3) and has a control bore (20), that penetrates a wall of the annular slide, said control bore is openable in the course of the pump piston stroke by the oblique control edges (23), (28) of the control recess (22) and in so doing connects the pump work chamber (4) with a fuel-filled low-pressure chamber surrounding the annular slide (15), in order to control the end of a high-pressure supply, the control bore (20) is disposed angularly to the pump piston axis and pierces a radial plane at an angle with respect to the pump piston axis in the annular slide (15), and an axis of the control bore 20 is disposed such that an ellipse-like entry cross section at the inner wall (21) of the annular slide (15) is located substantially parallel to the oblique control edge (23), (28) of the control recess (22).

2. A fuel injection pump of claim 1, in which said pump piston (3) has a clockwise control groove, and the control bore (20) in the annular slide (15) is turned clockwise out of an axial center position, by from about 10° to about 30°, in a radial plane pierced vertically by the pump piston axis of the pump work chamber (4), and that the control bore (20), seen in the radial direction with respect to the pump piston axis forms an angle from about 10° to about 30° with the radial plane.

3. A fuel injection pump of claim 1, in which the annular slide (15) is at least partly encompassed by an axially parallel-aligned wall which communicates via a lateral opening with a low-pressure fuel chamber; that two control recesses (22) on the pump piston (3) and two control bores (20) on the annular slide (15), which are associated with the control recesses (22), are disposed symmetrical with a plane passing through the pump piston axis and the opening, on both sides of the wall and opposite one another, and the outlet directions of the control bores (20) on the annular slide (15), in a directional component located in the radial plane, are aligned obliquely relative to the wall.

4. A fuel injection pump of claim 2, in which the annular slide (15) is at least partly encompassed by an axially parallel-aligned wall which communicates via a lateral opening with a low-pressure fuel chamber; that two control recesses (22) on the pump piston (3) and two control bores (20) on the annular slide (15), which are associated with the control recesses (22), are disposed symmetrical with a plane passing through the pump piston axis and the opening, on both sides of the wall and opposite one another, and the outlet directions of the control bores (20) on the annular slide (15), in a directional component located in the radial plane, are aligned obliquely relative to the wall.

5. A fuel injection pump of claim 1, in which an equal pressure valve member (6) is disposed between the pump work chamber (4) and an injection valve (8), said equal pressure valve member opens in an opening direction toward the injection valve (8) and a pressure holding valve (13) in a passage within said pressure valve member opens toward the pump work chamber (4), wherein the equal pressure valve member is raised from its valve seat (11) in the direction of the injection valve at an opening pressure of from about 5 to about 10 bar.

6. A fuel injection pump of claim 2, in which an equal pressure valve member (6) is disposed between the pump work chamber (4) and an injection valve (8), said equal pressure valve member opens in an opening direction toward the injection valve (8) and a pressure holding valve (13) in a passage within said pressure valve member opens toward the pump work chamber (4), wherein the equal pressure valve member is raised from its valve seat (11) in the direction of the injection valve at an opening pressure of from about 5 to about 10 bar.

7. A fuel injection pump of claim 3, in which an equal pressure valve member (6) is disposed between the pump work chamber (4) and an injection valve (8), said equal pressure valve member opens in an opening direction toward the injection valve (8) and a pressure holding valve (13) in a passage within said pressure valve member opens toward the pump work chamber (4), wherein the equal pressure valve member is raised from its valve seat (11) in the direction of the injection valve at an opening pressure of from about 5 to about 10 bar.

8. A fuel injection pump of claim 4, in which an equal pressure valve member (6) is disposed between the pump work chamber (4) and an injection valve (8), said equal pressure valve member opens in an opening direction toward the injection valve (8) and a pressure holding valve (13) in a passage within said pressure valve member opens toward the pump work chamber (4), wherein the equal pressure valve member is raised from its valve seat (11) in the direction of the injection valve at an opening pressure of from about 5 to about 10 bar.

9. A fuel injection pump of claim 2, in which an equal pressure valve member (6) is disposed between the pump work chamber (4) and an injection valve (8), said equal pressure valve member opens in an opening direction toward the injection valve (8) and a pressure holding valve (13) in a passage within said pressure valve member opens toward the pump work chamber (4), wherein the equal pressure valve member is raised from its valve seat (11) in the direction of the injection valve at an opening pressure of about 7 bar.

10. A fuel injection pump of claim 3, in which an equal pressure valve member (6) is disposed between the pump work chamber (4) and an injection valve (8), said equal pressure valve member opens in an opening direction toward the injection valve (8) and a pressure holding valve (13) in a passage within said pressure valve member opens toward the pump work chamber (4), wherein the equal pressure valve member is raised from its valve seat (11) in the direction of the injection valve at an opening pressure of about 7 bar.

11. A fuel injection pump of claim 4, in which an equal pressure valve member (6) is disposed between the pump work chamber (4) and an injection valve (8), said equal pressure valve member opens in an opening direction toward the injection valve (8) and a pressure holding valve (13) in a passage within said pressure valve member opens toward the pump work chamber (4), wherein the equal pressure valve member is raised from its valve seat (11) in the direction of the injection valve at an opening pressure of about 7 bar.

* * * * *